US009414688B2

(12) United States Patent
Gardner

(10) Patent No.: US 9,414,688 B2
(45) Date of Patent: Aug. 16, 2016

(54) CONVERTIBLE SOFA-BED

(71) Applicant: R-N-R International, Inc., Bristol, IN (US)

(72) Inventor: Stewart E. Gardner, Bristol, IN (US)

(73) Assignee: R-N-R International, Inc., Bristol, IN (US)

( * ) Notice: Subject to any disclaimer, the term of this patent is extended or adjusted under 35 U.S.C. 154(b) by 105 days.

(21) Appl. No.: 14/518,927

(22) Filed: Oct. 20, 2014

(65) Prior Publication Data

US 2016/0106221 A1 Apr. 21, 2016

(51) Int. Cl.

| | |
|---|---|
| ***A47C 17/32*** | (2006.01) |
| ***A47C 17/13*** | (2006.01) |
| ***A47C 17/16*** | (2006.01) |

(52) U.S. Cl.

CPC ..... *A47C 17/32* (2013.01); *A47C 17/13* (2013.01); *A47C 17/163* (2013.01)

(58) Field of Classification Search

CPC .. A47C 17/16; A47C 17/1655; A47C 17/165; A47C 17/163; A47C 17/207; A47C 17/2076; A47C 17/32; A47C 17/13; A47C 17/132; A47C 17/134; A47C 17/136; A47C 17/138

See application file for complete search history.

(56) References Cited

U.S. PATENT DOCUMENTS 1,783,530 A * 12/1930 Bebry ..... A47C 17/32 5/18.1
1,783,531 A * 12/1930 Bebry ..... A47C 17/32 5/18.1
2,660,734 A * 12/1953 Dumble ..... A47C 17/16 297/354.11
2,783,480 A * 3/1957 Shankman ..... A47C 17/30 5/18.1
2,932,541 A * 4/1960 Gulbrandsen ..... A47C 17/136 312/349
2,997,724 A * 8/1961 Heumann ..... A47C 17/132 5/18.1
3,061,870 A * 11/1962 Giannini, Sr. ..... A47C 17/32 16/261
3,080,574 A * 3/1963 Heisler ..... A47C 17/134 5/21
3,107,362 A * 10/1963 Clouse ..... A47C 17/138 5/17
3,284,813 A * 11/1966 Sevcik ..... A47C 17/138 5/17
3,905,053 A * 9/1975 Vuchelich ..... A47C 17/1655 5/17
3,906,558 A * 9/1975 Alembik ..... A47C 17/22 297/118

(Continued)

FOREIGN PATENT DOCUMENTS

DE 3722145 A1 * 2/1988 ..... A47C 17/36
DE 3738618 A1 * 5/1989 ..... A47C 17/36

*Primary Examiner* — David E Sosnowski
*Assistant Examiner* — Eric Kurilla
(74) *Attorney, Agent, or Firm* — R. Tracy Crump

(57) ABSTRACT

The convertible sofa-bed includes a base, a sliding and pivoting seat, a fold-out extension pivotally connected to the seat, and a fold-down seat back pivotally mounted to the base. The seat is pivotally connected to a pair of slides that ride on side rails mounted to the base, which allow the seat to be manually shifted between a horizontal seat position over base and a horizontal bed position spaced from the base. The seat is also pivotally connected to the slide by a ball joint that allows the seat to pivot upward so that the extension can be unfolded from beneath the seat. The ball joint connection between the slides and seat frame prevents the seat from binding when shifted between the seat position and the bed position even if the seat is not perfectly square with respect to the side rails as it is manually lifted and moved.

5 Claims, 12 Drawing Sheets

(56) References Cited

U.S. PATENT DOCUMENTS 3,908,210 A * 9/1975 Alembik ..... A47C 17/165 5/13
4,016,611 A * 4/1977 Harty ..... A47C 17/22 5/13
4,097,938 A * 7/1978 Pringle ..... A47C 17/04 384/219
4,204,287 A * 5/1980 Lane ..... A47C 17/23 5/13
4,292,697 A * 10/1981 Alembik ..... A47C 17/23 297/105
4,366,585 A * 1/1983 Ponti ..... A47C 17/132 5/18.1
4,378,609 A * 4/1983 Patterson ..... A47C 17/225 5/12.1
4,481,684 A * 11/1984 Hauck ..... A47C 17/22 5/18.1
4,504,987 A * 3/1985 Spitz ..... A47C 19/027 5/13
4,637,081 A * 1/1987 Clark ..... A47C 17/16 114/363
4,642,823 A * 2/1987 Wiggins ..... A47C 17/1756 5/37.1
4,672,696 A * 6/1987 Horenkamp ..... A47C 17/134 5/17
4,756,034 A * 7/1988 Stewart ..... A47C 17/1756 5/37.1
4,803,742 A * 2/1989 Rasnick ..... A47C 17/132 5/18.1
5,101,524 A * 4/1992 Brandschain ..... A47C 17/134 5/17
5,187,820 A * 2/1993 Froutzis ..... A47C 17/1756 5/37.1
5,231,710 A * 8/1993 Markel ..... A47C 17/13 297/107
5,249,317 A * 10/1993 Farlow ..... A47C 17/17 5/37.1
5,485,638 A * 1/1996 Newton ..... A47C 17/1756 5/37.1
5,628,076 A * 5/1997 Newton ..... A47C 17/1756 5/37.1
5,779,310 A * 7/1998 Suskey ..... A47C 17/2073 297/118
5,855,030 A * 1/1999 Williams ..... A47C 17/225 5/12.1
5,947,559 A * 9/1999 Williams ..... A47C 1/023 297/337
5,988,749 A * 11/1999 Williams ..... A47C 17/134 297/337
6,161,231 A * 12/2000 Kraft ..... A47C 17/22 5/12.1
6,397,411 B1 * 6/2002 Messina ..... A47C 17/132 5/21
7,562,402 B1 * 7/2009 Calloway ..... A47C 17/132 4/572.1
7,685,655 B1 * 3/2010 Delmestri ..... A47C 17/17 5/18.1
7,945,974 B2 * 5/2011 Cabrera ..... A47C 17/161 5/37.1
8,739,330 B2 6/2014 Smith et al.
2003/0005518 A1 * 1/2003 Grossman ..... A47C 17/1753 5/37.1
2003/0024044 A1 * 2/2003 Grossman ..... A47C 17/207 5/37.1
2008/0092290 A1 * 4/2008 Cabrera ..... A47C 17/161 5/47
2016/0051057 A1 * 2/2016 Murphy ..... A47C 17/134 5/29

* cited by examiner

CONVERTIBLE SOFA-BED

This invention relates to convertible sofa-beds and in particular a convertible sofa-bed used in recreational vehicles and the like.

BACKGROUND AND SUMMARY OF THE INVENTION

Convertible sofa-beds are highly desirable in applications where living space is limited, such as with recreational vehicles. Convertible sofa-beds typically include a base structure and a plurality of upholstered platform sections, which form the seat and backrest and can be manually shifted relative to the base frame between a sofa configuration and a bed configuration. Heretofore, pivots, hinges, linkages and tracks are used to convert the platform sections between the folded sofa and unfolded bed positions.

The convertible sofa-bed embodying this invention includes a base, a sliding and pivoting seat, a fold-out extension pivotally connected to the seat, and a fold-down seat back pivotally mounted to the base. The seat is pivotally connected to a pair of slides that ride on side rails mounted to the base, which allow the seat to manually shift between a horizontal seat position over the base and a horizontal bed position spaced from the base. The seat is also pivotally connected to the slide by a ball joint that allows the seat to pivot upward so that the extension can be unfolded from beneath the seat. The ball joint connection between the slides and seat frame prevents the seat from binding when shifted between the seat position and the bed position even if the seat is not perfectly square with respect to the side rails as it is manually lifted and moved.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENT

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
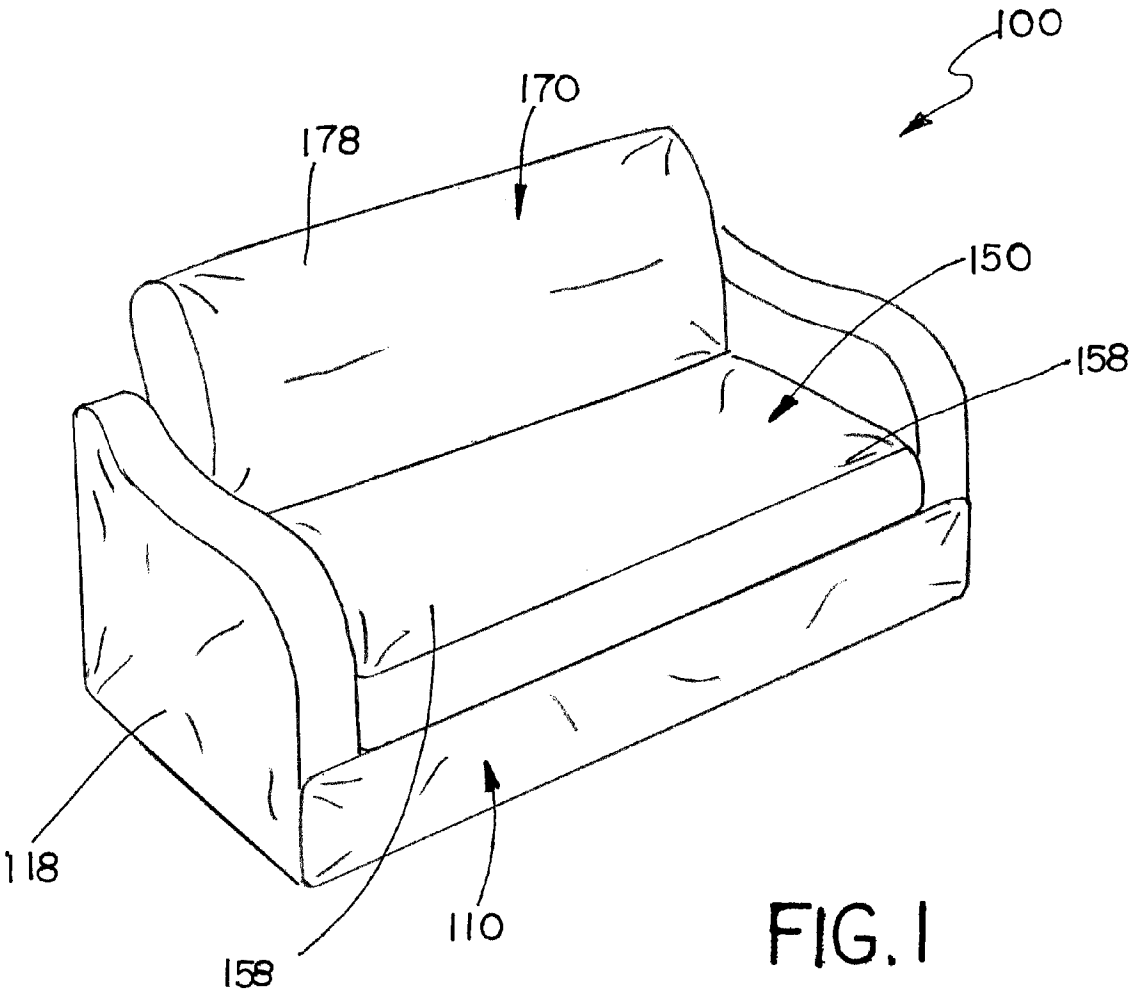
FIG. 1 is a perspective view of an exemplary embodiment of the convertible sofa-bed of this invention shown in the sofa orientation.
Figure 2:
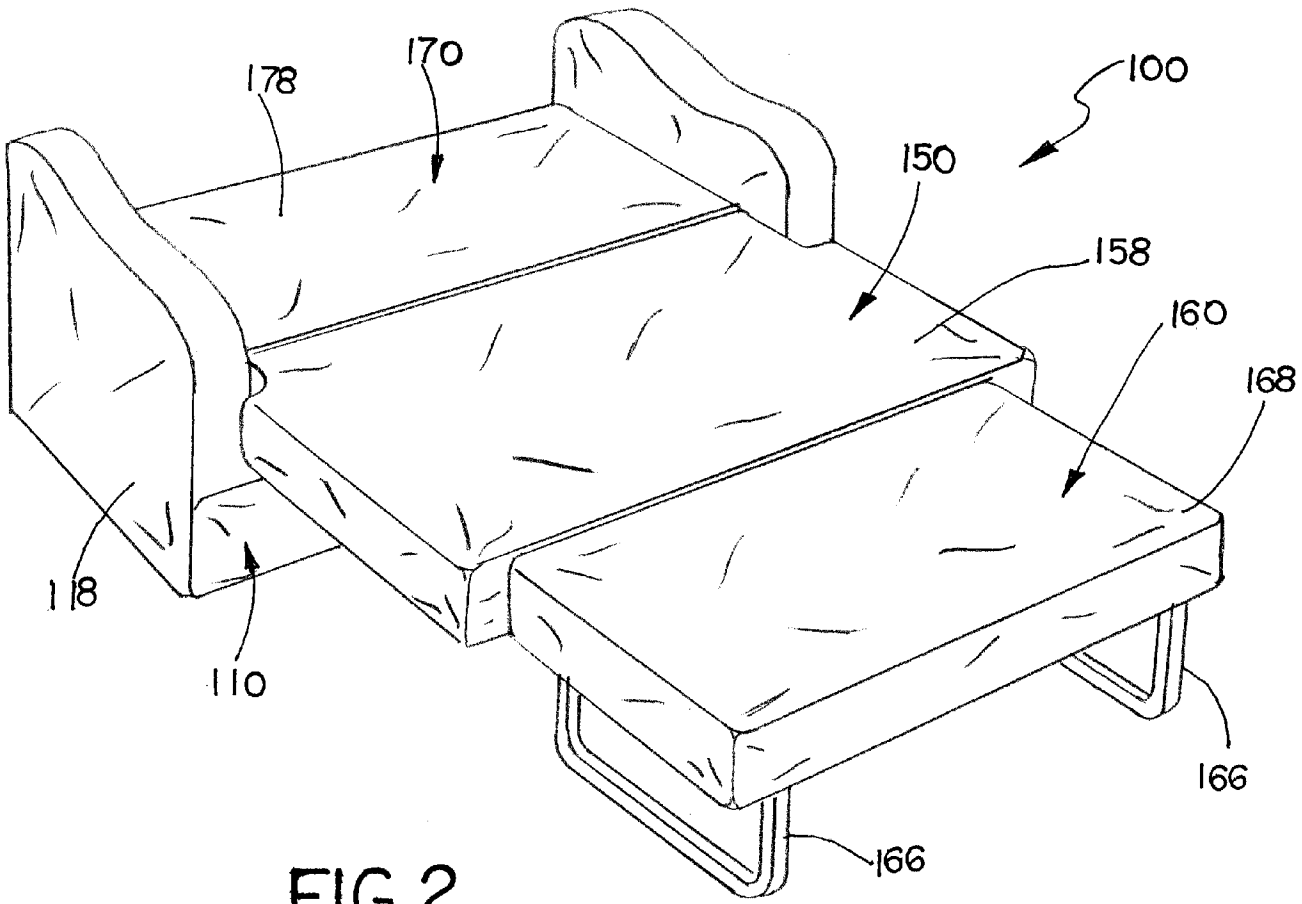
FIG. 2 is a perspective view of the convertible sofa-bed of FIG. 1 shown in the bed orientation.

Referring now to the drawings, FIGS. 1-6 illustrate an exemplary embodiment of the convertible sofa-bed of this invention, which is designated generally as reference numeral 100. Convertible sofa-bed 100 can be manually moved between a sofa orientation (FIG. 1) and a bed orientation (FIG. 2). Sofa/bed 100 includes a base 110, a sliding and pivoting seat 150 and a fold-out extension 160, and a fold-down seat back 170. Seat 150 is pivotally connected to a pair of slides 130 that ride on side rails 120 mounted to base 110 that allow the seat to be manually shifted between a horizontal seat position over the base (FIG. 1) and a horizontal bed position spaced from the base (FIG. 2). In addition, seat 150 is pivotally connected to slides 130 by a ball joint 140 that allows the seat to pivot upward so that extension 160 can be unfolded from beneath the seat. Extension 160 is pivotally connected to the seat to be manually pivoted between a storage position folded under the seat within the base 110 when the sofa-bed 100 is in the sofa orientation and a extended position unfolded from the seat (FIG. 2) when the sofa-bed is in the bed orientation. Seat back 170 is connected to sofa base 110 for pivotal movement between a raised upright position (FIG. 1) and lowered prone position (FIG. 2). In the sofa orientation, seat 150, extension 160 and back rest 170 are supported atop the base in a generally co-planar relation. In the sofa orientation, back rest 170 is pivoted upright, seat 150 is shifted rearward and bed extension 160 is disposed within sofa base 110 folded underneath the seat.

Sofa base 110, seat 150, extension 160 and back rest 170 each have an internal frame 112, 152, 162 and 172, respectively. These internal frames are typically constructed from welded lengths of metal tubing and channel with various bracketed reinforcements. In other embodiments, the base frame may be constructed of wood or other suitable materials. Seat frame 52 and extension frame 162 each includes a pair of hinge brackets 154 and 164. Extension frame 162 is pivotally connected to seat frame 152 by fasteners 156 that extend through aligned bores in hinge brackets 154 and 164. Hinge bracket 164 also act as stop blocks, which hold extension frame 162 in longitudinal alignment with seat frame 152 when unfolded. Seat frame 152 includes a pair of slide brackets 148. Seat back frame 122 is pivotally connected to a cross member 126 of base frame 112 by a pair of hinges 174. Although hinges are shown in this embodiment, any method of pivotal connection can be incorporated.

Figure 8:
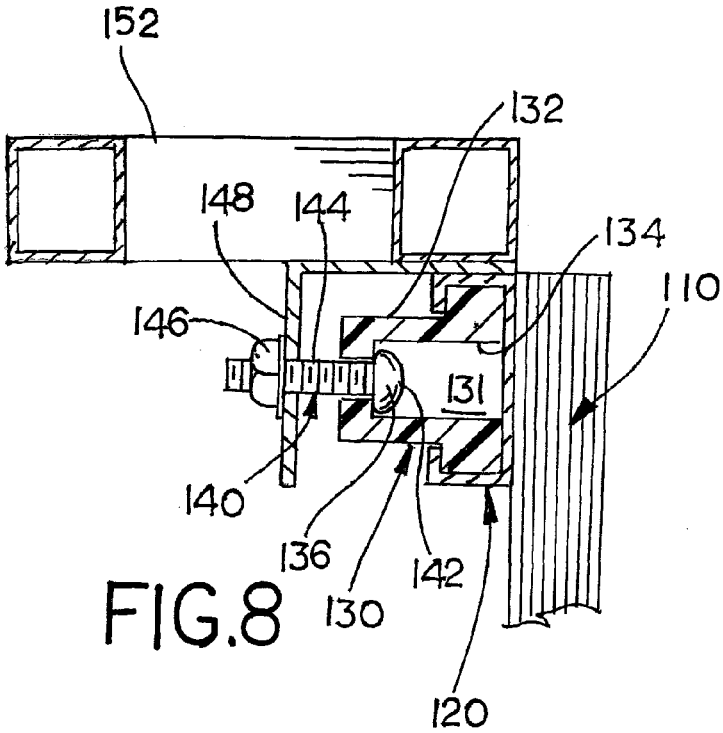
FIG. 8 is a partial end view of the rail and slide mechanism affixed to the seat frame as used in the convertible sofa-bed of FIG. 1.
Figure 9:
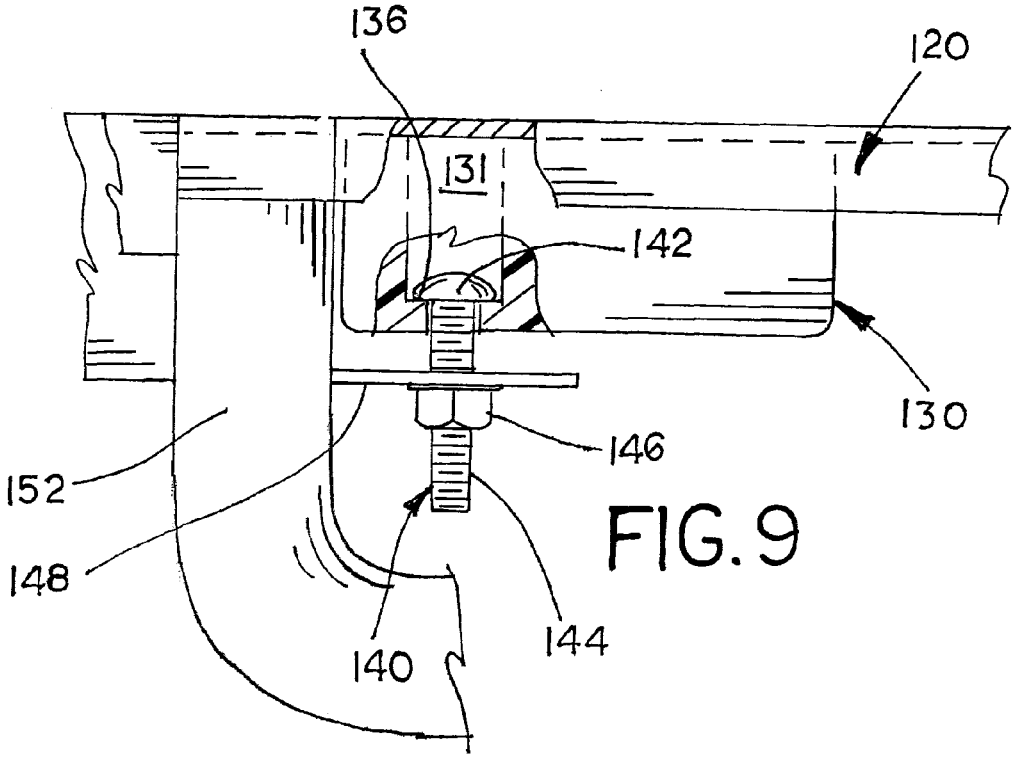
FIG. 9 is a top view with portions cutaway of the rail and slide mechanism affixed to the seat frame as used in the convertible sofa-bed of FIG. 1.
Figure 10:
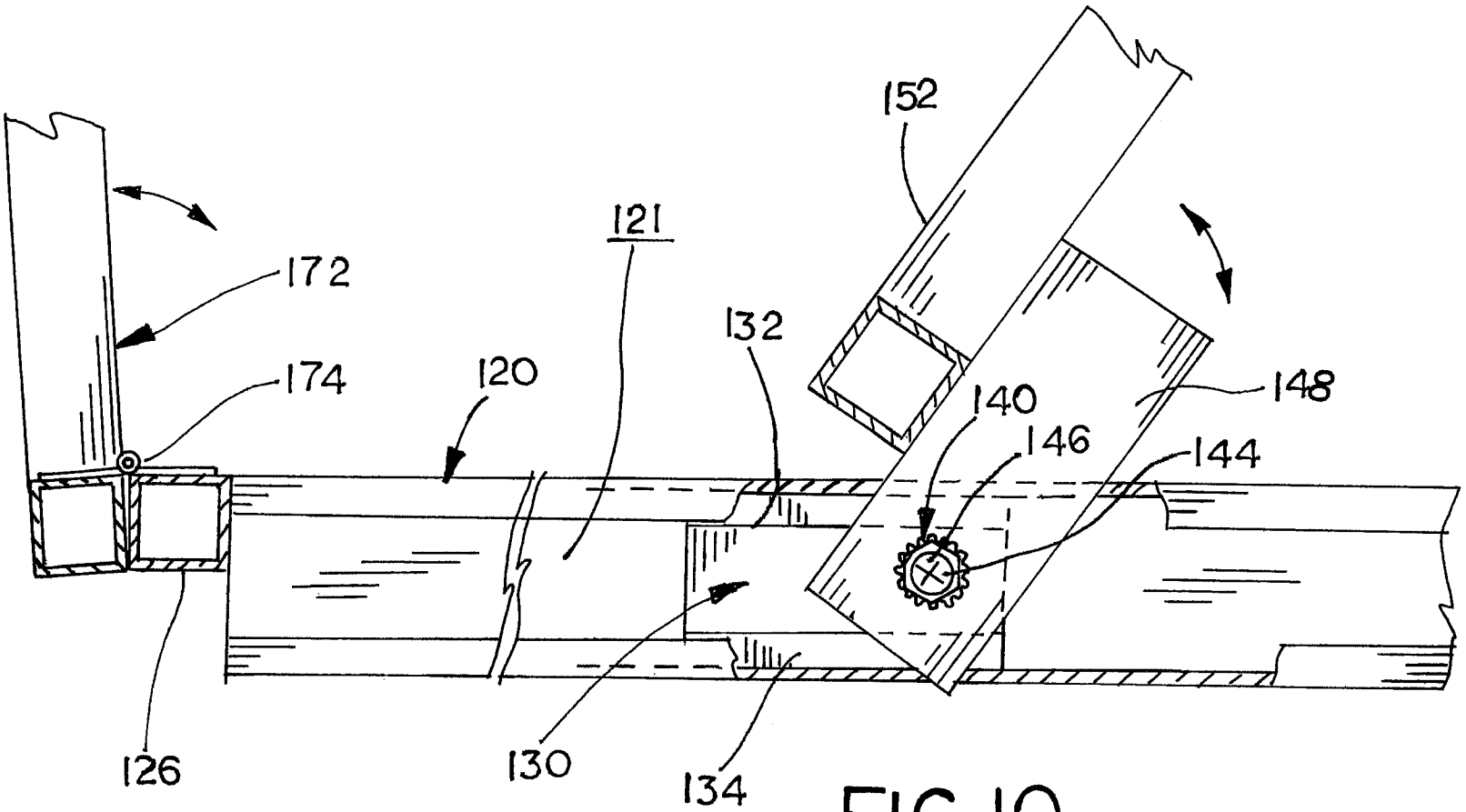
FIG. 10 is a side view of the internal frames used in the convertible sofa-bed of FIG. 1 shown in an intermediate orientation with the seat lifted.
Figure 11:
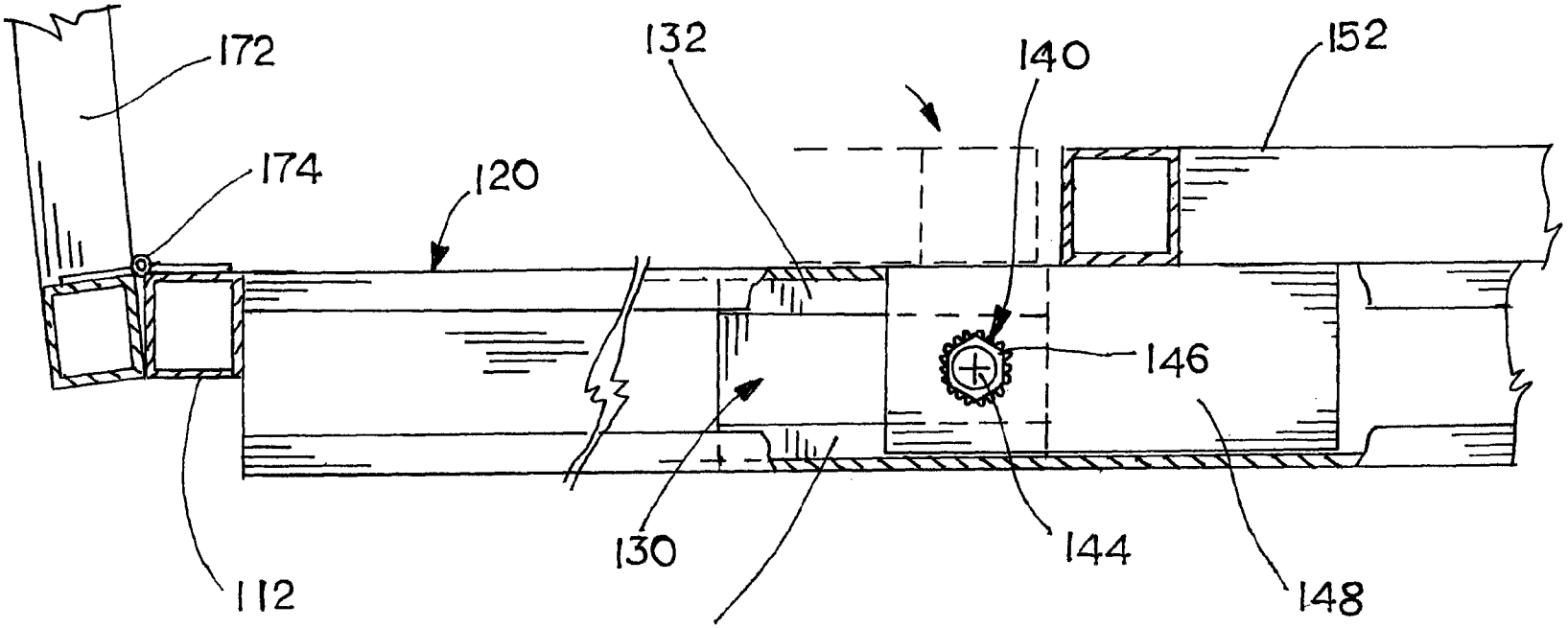
FIG. 11 is a side view of the internal frames used in the convertible sofa-bed of FIG. 1 shown in the bed orientation.
Figure 12:
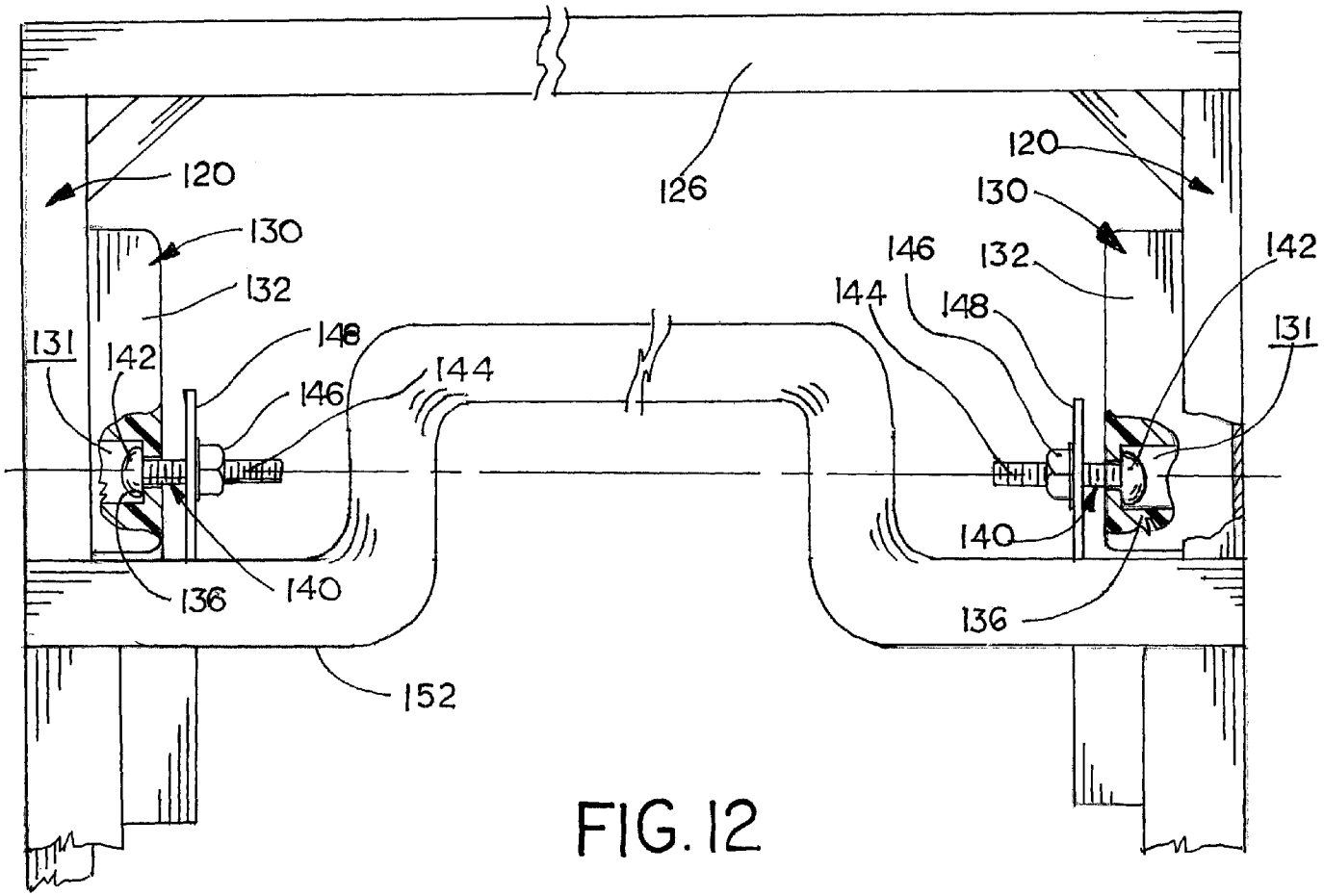
FIG. 12 is a top view of the internal frames used in the convertible sofa-bed of FIG. 1 showing the seat frame square with the base frame.
Figure 13:
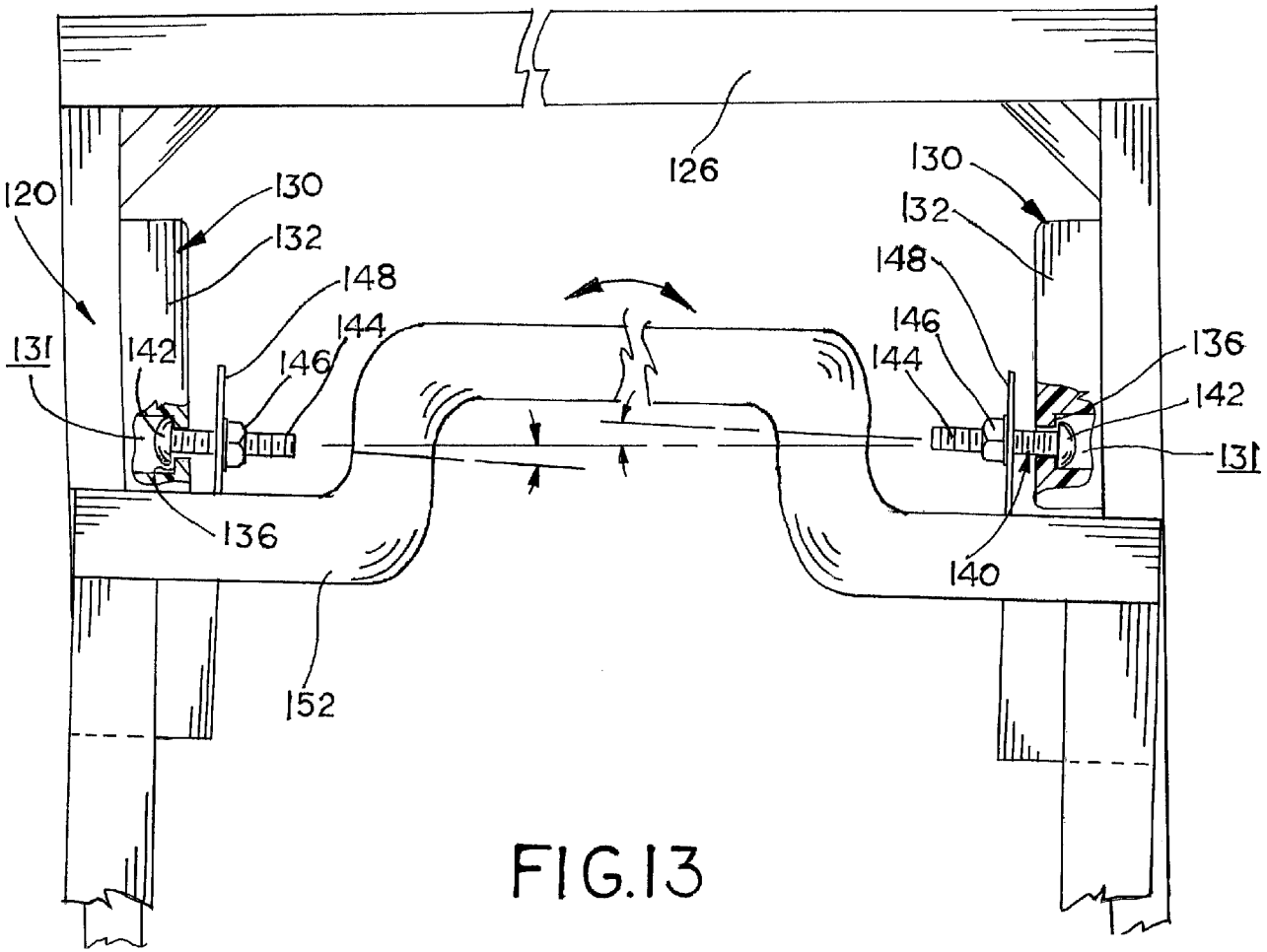
FIG. 13 is a top view of the internal frames used in the convertible sofa-bed of FIG. 1 showing the seat frame slightly misaligned with the base frame during conversion between the sofa and bed orientations.
Figure 14:
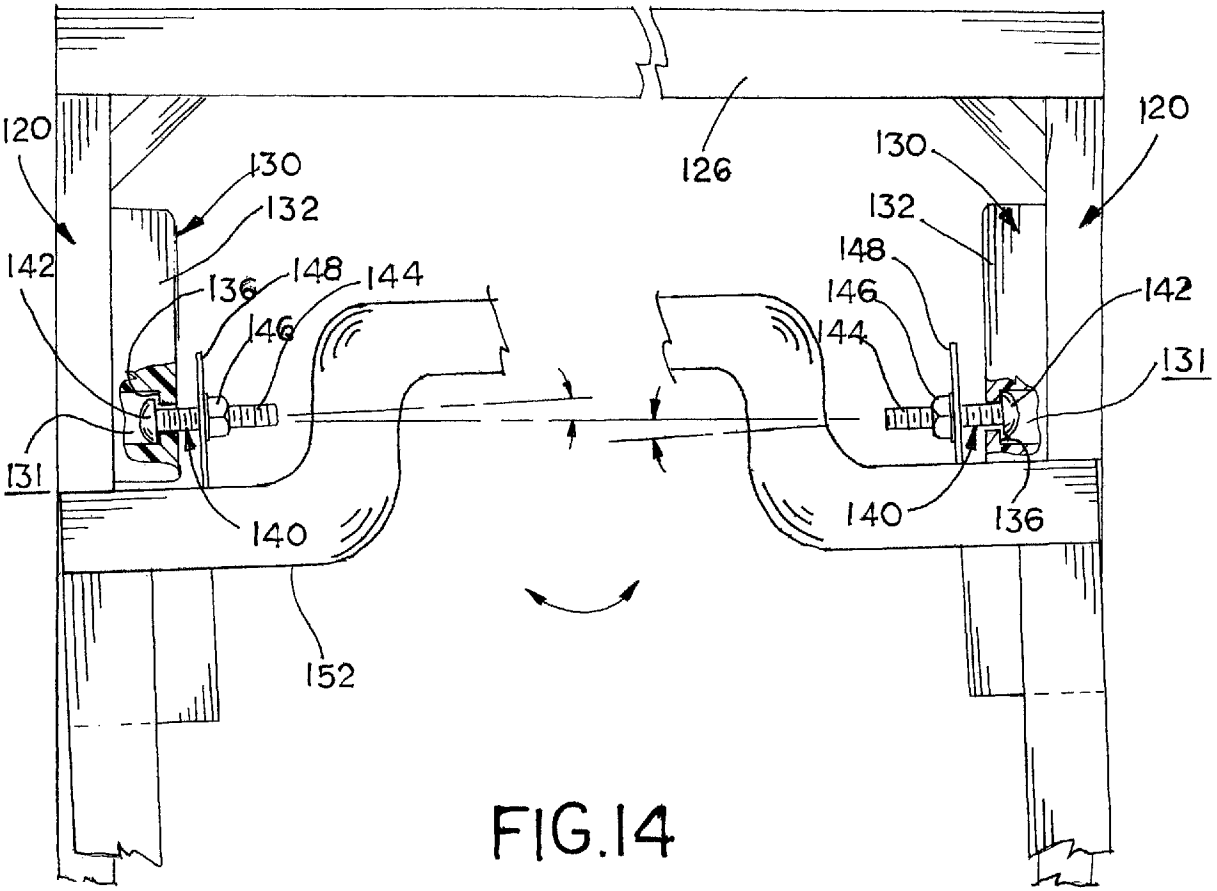
FIG. 14 is another top view of the internal frames used in the convertible sofa-bed of FIG. 1 showing the seat frame slightly misaligned with the base frame during conversion between the sofa and bed orientations.

Side rails 120 are mounted at opposite ends of base frame 112 by any suitable means, such as screws or welds. Side rails 120 are typically lengths of square metal tubing or C-channel cut or bent to have inward facing longitudinal slots 121. Rails 120 act as tracks for slides 130. A slide 130 is carried within each side rail 120 for traverse movement along the length of the rails. Slides 130 are typically fashioned or formed from a block of low friction material, such as Teflon and configured to conform to geometric configuration of side rails 120. Each slide 130 also has a counter sunk through bore 131. Seat frame 152 is pivotally connected to each slide 130 by a bolt 140 extending through counter suck bore 131. Bolt 140 includes a bolt head 142 and an elongated threaded shaft 144. As shown in FIGS. 8 and 9, bolt head 142 is disposed within counter sunk bore 131 and thread shaft 144 extends through a bore in slide bracket 148 and is secured by a lock nut 146. Bolt 140 allows seat 130 to be manually raised and lowered relative to the sofa base 110. In addition, counter sunk bore 131 and bolt 140 act as a ball joint and each are dimensioned to provide a measure or angular play so that seat 150 does not bind when moving between the seat position and the bed position (FIGS. 12-14). As shown, bolt head 142 seats against a shoulder 137 formed in counter sunk bore 131. The diameter of the bore walls and the shaft are dimensions to provide sufficient play and movement so that slides 130 will travel smoothly along side rails 120 even if seat frame 152 is not perfectly square with respect to the side rails as it is manually lifted and moved.

Figure 15:
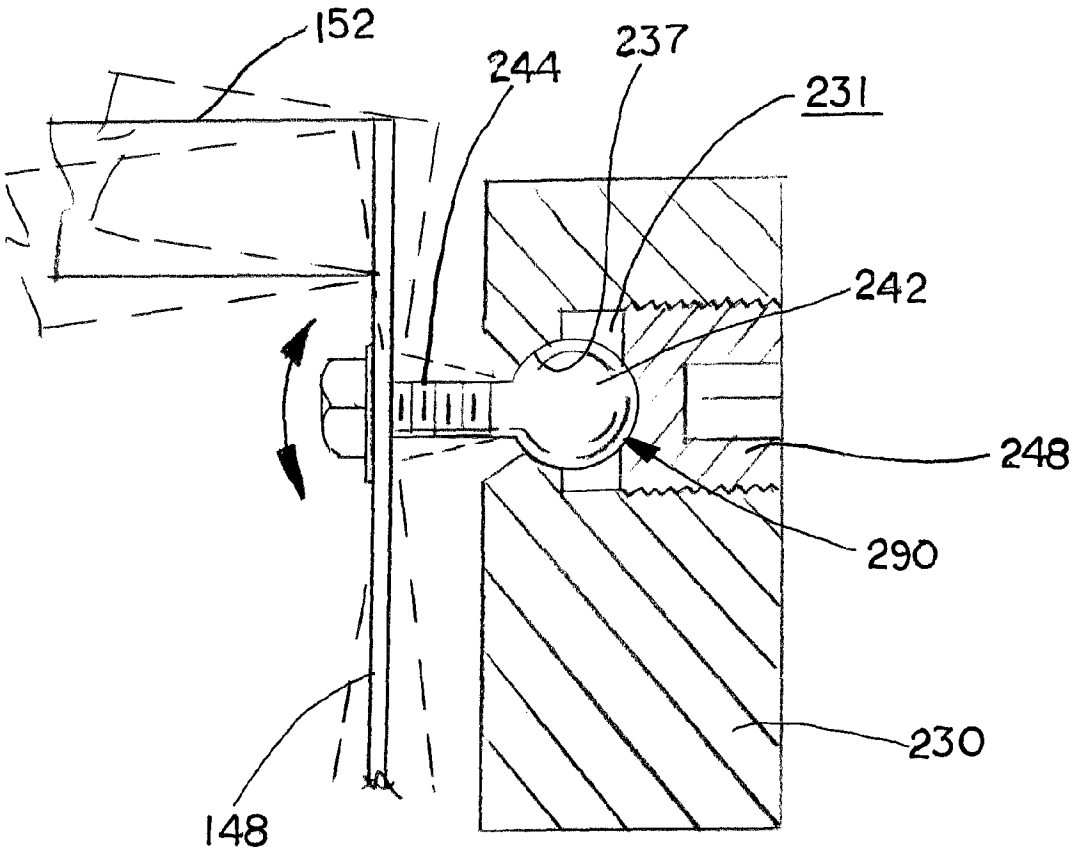
FIG. 15 is a top view of an alternative embodiment of the ball joint connection used with the slide and the seat frame.

FIG. 15 shows an alternative embodiment of the ball joint provided by a slide 230 and a specialized connector 240. Slide 230 again has a threaded countersunk bore 231. Connector 240 has a round head 292 and threaded shaft 244. Head 292 is seated within the counter sunk bore 231 of slide 230. Bore 231 has concave inner shoulders 237, which form a joint socket or seat to accommodate head 192. Bore 231 is enclosed by a thread plug 248, which seats against head 242 and prevents lateral movement of connector 240 within bore 231.

Extension 140 also includes a pair of folding legs 144. Folding legs 144 support extension 140 when sofa/bed 100 is in its horizontal bed position (FIG. 2) and fold flat against extension frame 142 when the sofa/bed 100 is in its sofa position (FIG. 1). Folding legs 148 are pivotally mounted to bed extension frame 152 by hinges (not shown). In the sofa orientation, the legs 148 are folded beneath the extension frame 142. In the bed orientation, the legs 148 are extended as shown to support extension 140 which extends from seat 130. Legs 148 are preferably formed of metal, in a tubular form, or any other material sufficient to support weight borne by the convertible sofa-bed 100 when in the bed orientation. Legs 148 are locked into their deployed position by any suitable mechanism, such as a snap key or other mechanical lock (not shown).

Figure 3:
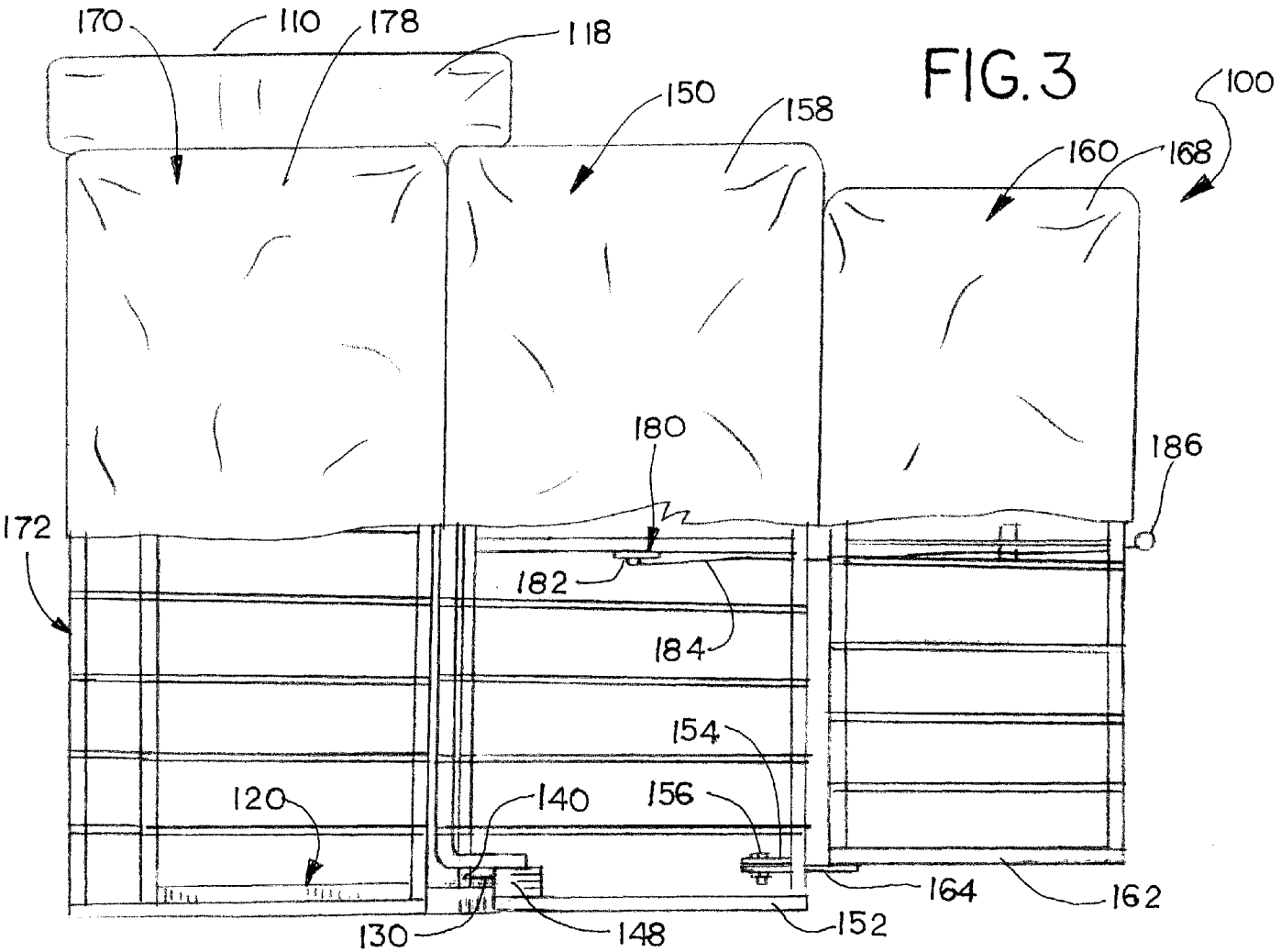
FIG. 3 is a top view of the convertible sofa-bed of FIG. 1 with a portion of the cushions cut away to shown the internal frames.
Figure 4:
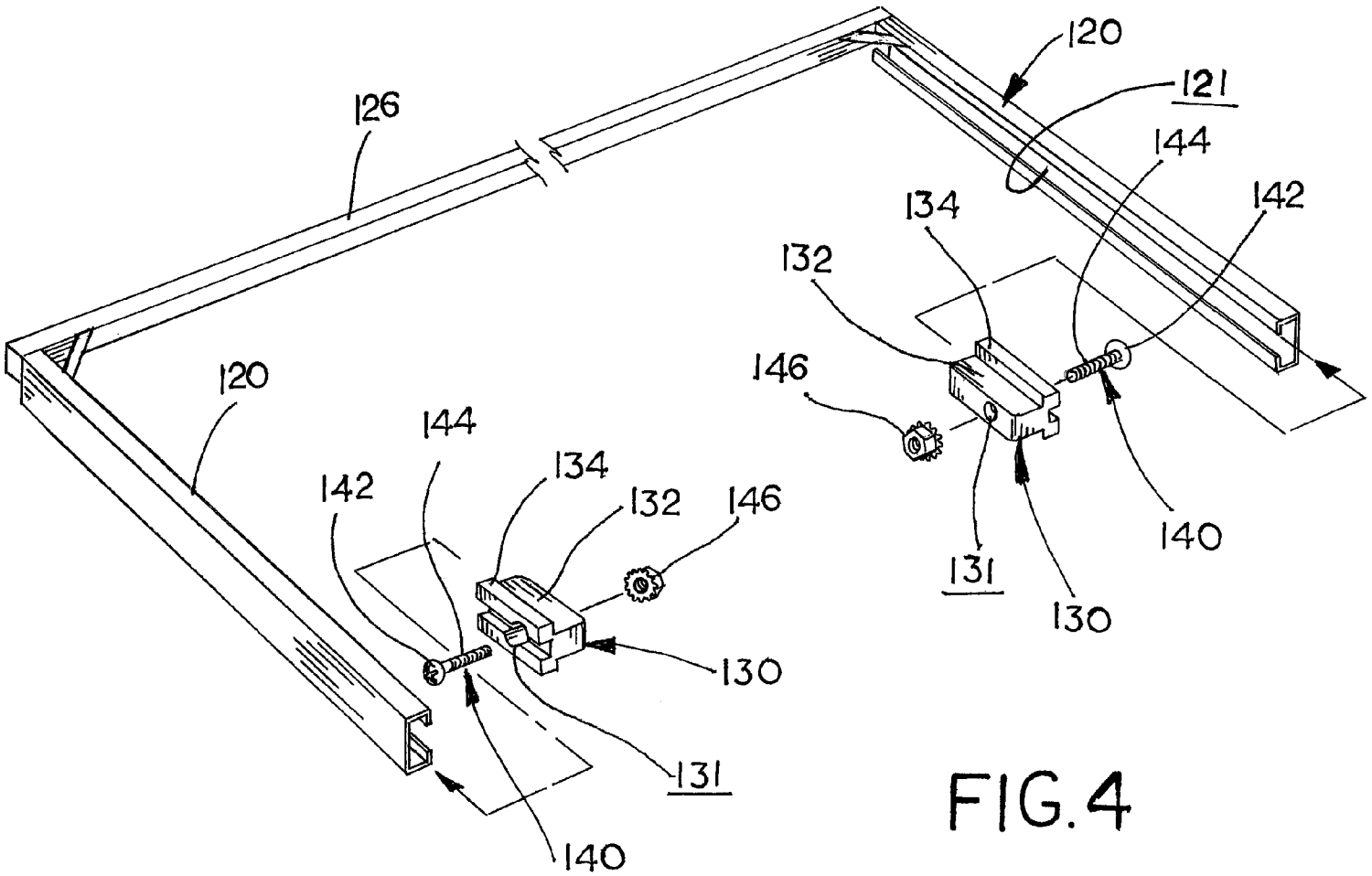
FIG. 4 is a partial exploded view of the side rails and slides used in the convertible sofa-bed of FIG. 1.
Figure 5:
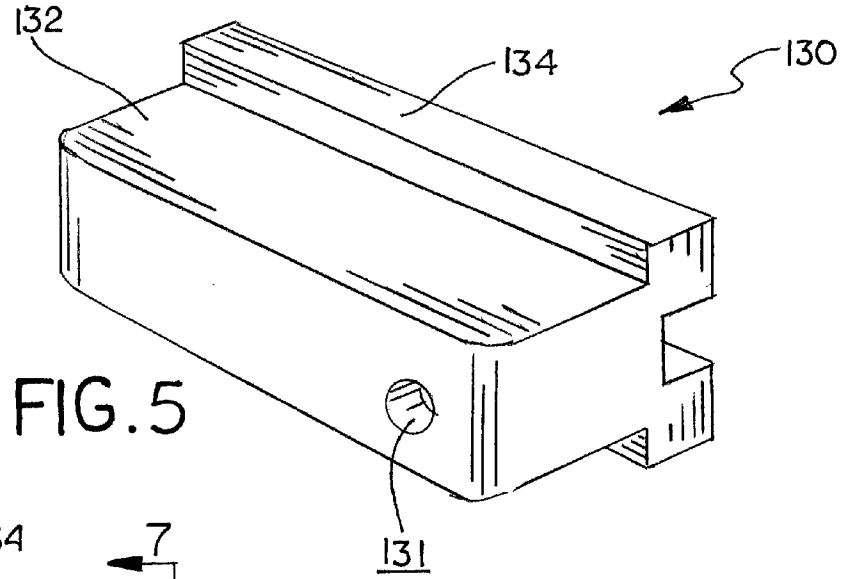
FIG. 5 is a perspective view of the slides used in the sofa-bed of FIG. 1.
Figure 6:
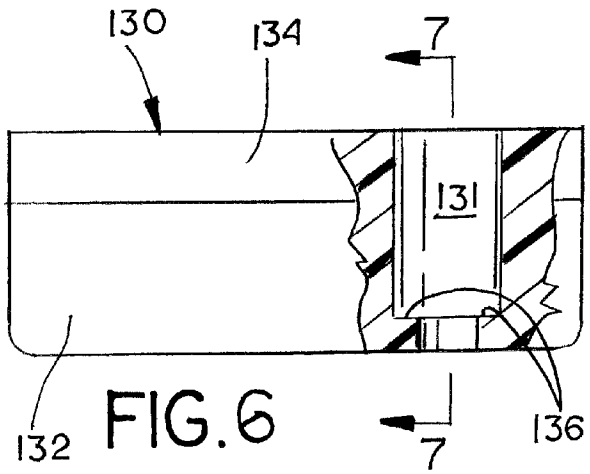
FIG. 6 is a top view with a portion cut away of the slide of FIG. 5.
Figure 7:
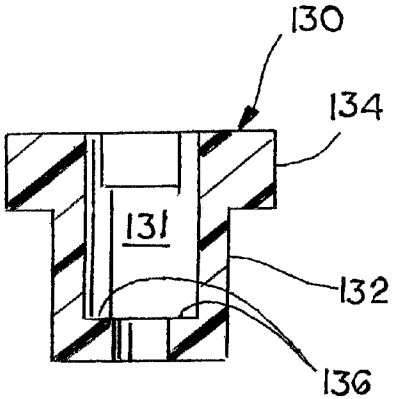
FIG. 7 is an end sectional view of the slide of FIG. 5 taken along line 7-7 of FIG. 6.

As best shown in FIG. 3, sofa-bed 100 also includes lock mechanism 180 mounted to extension frame 162, which holds and locks seat 150 and extension 160 in the bed orientation. Lock mechanism 180 may be of any conventional design and function. As shown, lock mechanism 180 includes a locking part 182 mounted to the bottom of seat frame 152 that restrictively engages both the seat frame 152 and the extension frame 162. Locking part 182 is operatively connected to a pull knob 186 by a cable 184. Mannually pulling knob 186 deactivates locking part 182 and allows seat 150 and extension 160 to be manually moved from the bed orientation to the sofa orientation.

As shown, base frame 112 is covered with a padded upholstery of cloth, leather or vinyl. Seat, extension and beck bask frames 152, 162 and 172 supports removable cushions 131, 141 and 151. Seat, extension and seat back frames 152, 162, 172 includes a plurality of suspension bands that form a platform on which cushions or padded upholstery are supported. While the spaced bands are illustrated in the drawings, other embodiments of the internal frame may includes a solid surface platform, wire supports, springs and any other means of supporting the cushions and padded upholstery. Cushions 151, 161 and 171 are of conventional construction and typically fashioned of a medium or high density foam body covered in cloth, vinyl or leather with a zipper or other suitable closure to allow replacement of the foam body. Removable cushions may be secured to their respective frames using hook and loop fasteners, snaps, or any other suitable method, which prevents the cushions from shifting atop the cushion frame as the sofa/bed is moved between the sofa and bed positions. Otherwise, the cushions may simply be placed atop the frames. While cushions 151, 161 and 171 are illustrated as removable cushions supported by atop or against frames 152, 162 and 172, in alternative embodiments, one or more of the cushions may be affixed directly to the frames or the internal frames simply covered with an padded upholstery, as desired.

To move sofa-bed 100 from the sofa orientation (FIG. 1) to the bed orientation (FIG. 2), seat 150 is lifted upward and slid forward. With seat 150 lifted and slid forward, extension 160 can be pivoted outward and legs 166 unfolded. Typically, locking part 182 activates once extension 160 is fully unfolded. Once legs 166 are unfolded, seat 150 and extension 160 can be lowered and seat back 170 pivoted downward into its lowered position. To return sofa/bed 100 from the bed orientation (FIG. 2) to the sofa orientation (FIG. 1), seat back 120 is first manually raised to its upright position. Next, lock mechanism 180 is deactivated to allow extension 160 to be stowed under seat 150. Seat 150 is manually raised pivoting upward away form sofa base 110. Extension legs 166 are folded under extension frame 162 and extension 160 is pivoted back under seat 150. Once extension 160 is stowed, seat 150 is lowered and slid back over sofa base 110 to its sofa position.

One skilled in the art will note several advantages of the convertible sofa-bed embodying this invention over conventional convertible sofa-beds. The use of rail mounted slides allows the seat to glide smoothly between the sofa and bed positions with little manual force. In addition, the use of ball joint connection between the slides and seat frame not only allows the seat to pivot upward to give access to the extension but reduces any binding when the seat is moved between the sofa and bed position. Reducing the binding that occurs when the seat is not perfectly square to the rails further improves the ease of operation.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

I claim:

1. A convertible sofa bed comprising:

a base;

a pair of rails mounted to the base and spaced apart from one another; a slide carried by each of the pair of rails for traverse movement along the length thereof;

a seat pivotally connected to the slide of each rail of the pair of rails between each of the pair of rails by a ball joint for pivotal movement away from the base and for traverse movement between a first horizontal position spaced over the base and a second horizontal position spaced adjacent to the base;

wherein the slide of each rail of the pair of rails has a countersunk through bore therein, and the ball joint is formed by a joint part having a shaft extending from the slide through the countersunk bore of the slide and an integral head pivotally disposed within the countersunk bore of the slide.

2. The convertible sofa-bed of claim 1 wherein the shaft of the joint part is connected to the seat.

3. The convertible sofa-bed of claim 1 and an extension pivotally connected to the seat for movement between a folded position where the extension underlies the seat and an unfold position where the extension is aligned horizontally to the seat.

4. The convertible sofa-bed of claim 1 and a back rest pivotally connected to the base for movement between an upright position and a horizontal position.

5. A convertible sofa bed comprising:

a base;

a pair of rails mounted to the base and spaced apart from one another; a slide carried by each of the pair of rails for traverse movement along the length thereof, the slide of each rail of the pair of rails has a counter-sunk through bore therein;

a seat pivotally connected to the slide of each rail of the pair of rails between each of the pair of rails by a ball joint for pivotal movement away from the base and for traverse movement between a first horizontal position spaced over the base and a second horizontal position spaced adjacent to the base, the ball joint is formed by a joint part having a shaft extending from the slide through the countersunk bore of the slide and an integral head pivotally disposed within the countersunk bore of the slide, the shaft of the joint part is connected to the seat;

an extension pivotally connected to the seat for movement between a folded position where the extension underlies the seat and an unfolded position where the extension aligned horizontally to the seat; and a back rest pivotally connected to the base for movement between an upright position and a horizontal position.

* * * * *